United States Patent [19]

Dethienne

[11] Patent Number: 4,857,877

[45] Date of Patent: Aug. 15, 1989

[54] TRANSFORMER HAVING COAXIAL COILS

[75] Inventor: Henri-Pierre Y. Dethienne, Wavre, Belgium

[73] Assignee: U.S. Philips Corporation, New York, N.Y.

[21] Appl. No.: 215,702

[22] Filed: Jul. 5, 1988

Related U.S. Application Data

[63] Continuation of Ser. No. 914,089, Oct. 1, 1986, Pat. No. 4,774,756.

[30] Foreign Application Priority Data

Oct. 11, 1985 [NL] Netherlands ..... 8502776

[51] Int. Cl.[4] ..... H01F 41/06

[52] U.S. Cl. ..... 336/170; 336/198

[58] Field of Search ..... 29/605, 618, 622, 418; 242/7.03; 336/196, 198, 170, 171, 208

[56] References Cited

U.S. PATENT DOCUMENTS 4,023,262 5/1977 Miknaitis ..... 29/605

4,419,814 12/1983 Hasserjian ..... 29/605

FOREIGN PATENT DOCUMENTS 1246458 9/1971 United Kingdom .

*Primary Examiner*—Timothy V. Eley

*Attorney, Agent, or Firm*—Bernard Franzblau

[57] ABSTRACT

A method of manufacturing a transformer with coaxial coils. A coil bobbin (1) is provided with a first flange (3) and a second flange (5) between which a winding space is informed in which a first coil (9) is wound. Around the first coil an electrically insulated foil (13) is fitted, on which one or more second coils (15, 17) are wound. An essentially U-shaped spacer (23) made of an electrically insulating material is placed, before the winding of the second coil (15, 17), around the insulating foil (13) such that its members (27) extend axially into the winding space. Each of the members (27) is provided near the first flange (3) with a first radial projection (29) and near the second flange (5) with a second radial projection (31). These projections define a minimum possible distance between the second coil (15, 17) and the first and second flanges. Each member (27) of the spacer is preferably also provided with at least a third radial projection (33) which separates two successive second coils (15 and 17) from each other in the axial direction.

7 Claims, 1 Drawing Sheet

TRANSFORMER HAVING COAXIAL COILS

This is a continuation of application Ser. No. 914,089, filed Oct. 1, 1986 now U.S. Pat. No. 4,774,756.

BACKGROUND OF THE INVENTION

This invention relates to a transformer and a method of manufacturing a transformer. The method comprises the steps of providing a coil bobbin having a first and a second end on which are situated respectively a first flange and a second flange, said flanges defining a winding space on the coil bobbin, at least the first flange being provided with radially extending edge slots; winding a first coil in the winding space, said coil being formed from a wire conductor, the ends of which are led out via at least one of the edge slots; applying an electrically insulating foil over the first coil; and winding at least one second coil on the said foil.

A transformer of this kind is known, for example, from U.S. Pat. No. 4,449,111. The insulating foil serves for electrically separating the first and the second coils from each other. Special measures are needed to ensure that, near the flanges, the conductors of the first and the second coil do not come too close together since there would then be a danger that the creep path between the first and the second coil could become impermissibly short or even that a conductor of the second coil could slide over the edge of the foil and come into contact with the first coil. Such measures consist, for example, in the application of a separate coil bobbin consisting of two parts for the second coil, which coil bobbin is placed around the first coil, or in the application of a corrugated edge to the foil which is folded against the sides of the flange directed towards the winding space, thereby ensuring a minimum distance between the first and the second coil. These solutions are however relatively expensive and offer little scope for modifying the design of the transformer, for example by changing the number of second coils.

SUMMARY OF THE INVENTION

It is an object of the invention to improve a method of the kind mentioned in the preamble in such a way that, with little cost, an assured distance can be maintained between the conductors of the first and second coils, while modifications in the design are relatively easy to implement.

To this end the method according to the invention is characterized in that, before the winding of the second coil, an essentially U-shaped spacer made from electrically insulating material is placed over the insulating foil in such a way that its members extend axially into the winding space, said members being each provided with a first radial projection near the first flange and a second radial projection near the second flange, said projections defining a minimum possible distance between the ends of the second coil and the first and second flanges.

The spacer is a simple component that can be manufactured at low cost from a suitable plastic, for example by extrusion moulding. If it is desired to fit more than one second coil on the transformer, a further feature of the method according to the invention can be used with advantage, which is characterized in that at least two second coils are wound and in that each of the members of the spacer is provided with at least one third radial projection, said third radial projections being situated at corresponding axial positions on the two members and axially separating the second coils from each other.

BRIEF DESCRIPTION OF THE DRAWINGS

The invention will now be explained in more detail with reference to the drawings, in which.

DESCRIPTION OF THE PREFERRED EMBODIMENT

Figure 1:
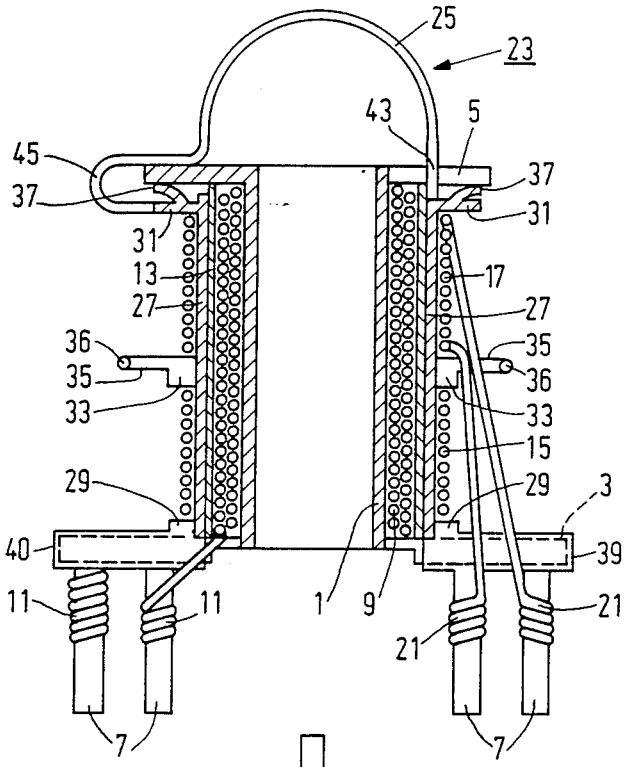
FIG. 1 shows a longitudinal section of an embodiment of a transformer manufactured by the method according to the invention.
Figure 2:
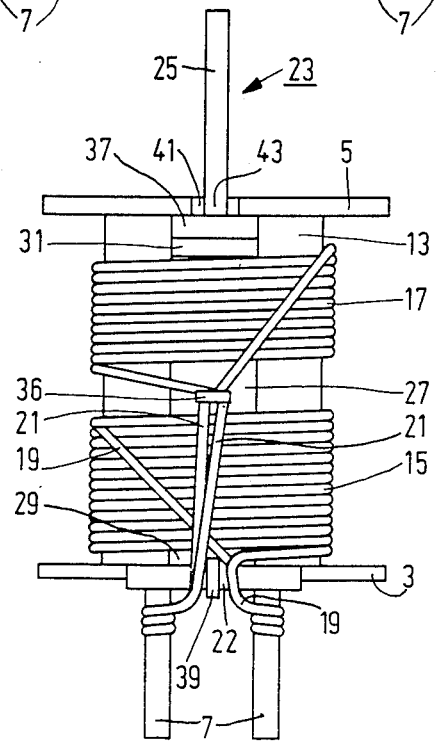
FIG. 2 shows a side view of the transformer depicted in FIG. 1.

The depicted transformer contains a coil bobbin 1 of electrically insulating material, for example plastic. The coil bobbin 1 has the shape of a hollow tube with a round or polygonal lateral section in which, if required, a ferromagnetic core (not shown) can be fitted. If no core is fitted, the coil bobbin can also be made in solid form. The coil bobbin 1 has a first end on which a first flange 3 is provided (at the bottom in FIGS. 1 and 2) and a second end on which a second flange 5 is provided (at the top in the figures). The coil bobbin 1 and the flanges 3, 5 are preferably formed as a single entity, for example by extrusion moulding. Located on the coil bobbin 1 between the flanges 3, 5 is a winding space. In the first flange 3 electrically conducting connector pins 7 are fixed, which may be for example soldered on a printed wiring board (not shown). In the winding space there is wound a first coil 9, which for example forms the primary coil of the transformer. The first coil 9 consists of a number of turns of a wire electrical conductor whose ends 11 are led out of the winding space on the left side of FIG. 1 via a first radially extending edge slot in the first flange 3. Each of these wire ends is electrically and mechanically connected to one of the connector pins 7, for example by winding one of the ends a few times around the connector pin and then fixing it by soldering.

Fitted around the first coil 9 is an electrically insulating foil 13, around which two second coils 15, 17, which for example form the secondary coils of the transformer, are wound coaxially with the first coil. The second coils 15, 17 also consist of a number of turns of a wire electrical conductor and their ends 19 and 21, respectively, are led out on the right side in FIG. 1 via a second edge slot 22 (see FIG. 2) to the connector pins 7 and fixed thereto. Before the winding of the second coils 15, 17 a spacer 23 made of an electrically insulating material, for example plastic, is placed over the foil 13. The spacer 23 is essentially U-shaped with a semi-circular base part 25, which is situated outside the second flange 5 and with two members 27 which extend axially into the winding space. The base part 25 is somewhat elastic so that the members 27 are clamped against the foil 13. Each of the members 27 is provided with a first radial projection 29 near the first flange 3 and a second radial projection 31 near the second flange 5. The first projections 29 define the minimum possible distance in the axial direction between the lower second coil 15 and the first flange 3 and the second projections 31 define the smallest possible distance in the axial direction between the upper second coil 17 and the second flange 5. Consequently the second coils 15, 17 always terminate at a specific distance from the flanges 3, 5 and from the edge of the foil 13 which extends up to these flanges. This ensures that there is always a predetermined distance and hence a good electrical separation present between the first coil 9 and the second coils 15, 17. In order to also ensure a good electrical separation 23 is further provided with a third radial projection 33, said third radial projections being situated at corresponding axial positions between the first projections 29 and the second projections 31. The third projections 33 define a minimum possible distance in the axial direction between the two second coils 15 and 17. If the transformer contains more than two second coils, the members 27 can of course be provided with more third projections 33. The design of the transformer can thus easily be changed by choosing a spacer with a different number of third projections 33. The spacers can be manufactured very simply by means of extrusion moulding. Their manufacturing cost is very low, especially in mass production. If desired it is possible to make a single spacer with the maximum required number of third projections (for example three pairs if at the most four second coils are to fitted) and to cut off one or more pairs of third projections if a transformer is to be made with fewer second coils. In this case only one extrusion die is needed, which cuts the manufacturing cost still further.

In general the wire ends 21 of the upper second coil 17 must be led along the lower second coil 15 to the connector pins 7. Of course, these wire ends too must remain at a predetermined distance from the lower second coil. For this reason the third radial projections 33 are provided with a radial pin 35 around which the wire ends 21 are led at some distance from the lower second coil 15 to the connector pin 7. The pin 35 is given a thickening 36 at its free end to prevent the coil-wire ends 21 from slipping from the pin.

As remarked above, the members 27 of spacer 23 are pressed against the foil 13 by the spring force of the base part 25, so that the spacer cannot fall from the foil. A way of fixing the spacer 23 to the transformer even more firmly is adopted in the illustrated embodiment in that the members 27 are provided with elastic lugs 37 which are situated in the winding space near the two projections 31. When the spacer 23 is fitted these lugs elastically engage the inside of the second flange 5. The free ends of the members 27 rest against the inside of the first flange 3 so that the members are clamped by spring force between the two flanges. Any tolerances in the length of the members or of the winding space are taken up by the elastic lugs 37.

The wire ends of the first and second coils 9, and 15, 17 respectively, are led, as already remarked, via edge slots 22 in the first flange 3 to the connector pins 7. To limit the number of edge slots and still maintain electrical separation between the wire ends, the members 27 are provided near the first radial projections 29 with radial strips 39, 40 which are located in the edge of the first flange 3. The strip 39 divides the slot 22 into two parallel slots through each of which a pair of wire ends 19, 21 of one of the secondary coils 15 and 17, respectively, can pass, the wire ends are then electrically insulated from each other by the strip. The strip 40 keeps the two wire ends 11 of the first coil 9 separated from each other.

The second flange 5 likewise contains a radially extending edge slot 41, through which passes a straight connecting portion 43 between one of the members 27 (the right-hand member in FIG. 1) and the base part 25 of the spacer 23. In the edge of the second flange 5 situated diametrically opposite no slot is provided. Here the member 27 (the left-hand member in FIG. 1) is connected to the base part 25 via a U-shaped connecting portion 45 that grips around the flange and whose members lie on opposite sides of the flange. Of course it is also possible to connect both members 27 in the same way to the base part 25, either both via straight connecting portions 43, or both via U-shaped connecting portions 45. After the winding of the second coils 15, 17 the base part 25 can, if desired, be removed by cutting through the connecting portions 43, 45. The members 27 are then held in place by the second coils 15, 17. The removal of the base part 25 reduces the dimensions of the transformer and makes it easier to place a ferromagnetic core into the central opening of the coil bobbin 1. After completion, the transformer including a core can, if desired, be encapsulated in a suitable plastic moulding.

The transformer described is particularly suited for automated winding. The wire ends 19, 21 or the second coils 15, 17 do not always have to be fixed to connector pins 7. For some applications it may be desirable for these wire ends to be connected directly with other components of a circuit.

What is claimed is:

1. A transformer comprising: a coil bobbin having first and second spaced apart end flanges which define a winding space therebetween, at least the first end flange having radially extending edge slots, a first wire conductor coil mounted on the bobbin in said winding space and with the wire ends led out via at least one of the edge slots, an electrical insulating foil located about the first coil, a U-shaped spacer made of electrical insulating material positioned over the insulating foil, said spacer having members extending axially into the winding space, each of said members having first and second radial projections located near the first and second end flanges, respectively, and second coil means wound on the spacer coaxially with the first coil and with said first and second projections defining a minimum distance between ends of the second coil means and the first and second end flanges.

2. A transformer as claimed in claim 1, wherein at least one of the spacer members is connected with a base part thereof via a U-shaped connecting portion having members which lie on opposite sides of the second flange.

3. A transformer as claimed in claim 1 wherein the spacer members have radial strips near the radial projections, said radial strips fitting into the edge slots of the first flange in order to provide an electrical separation between two coil wire ends led out through the same edge slot.

4. A transformer as claimed in claim 1 wherein the members of the spacer are provided with lugs which, elastically engage the flanges.

5. A transformer as claimed in claim 1 wherein the second coil means comprises at least two second coils and each of said spacer members includes a third radial projection with said third radial projections located at corresponding axial positions on the members and axially separating the second coils from each other.

6. A transformer as claimed in claim 5 wherein at least one of the third radial projections is provided with a radial pin around which the ends of at least one of the second coils are led to connector pins.

7. A transformer as claimed in claim 1 wherein at least one of the members of the spacer is connected with a base part thereof via a straight connecting portion which passes through a radial edge slot in the second flange.

* * * * *